US010939770B2

(12) United States Patent
López Gil

(10) Patent No.: US 10,939,770 B2
(45) Date of Patent: Mar. 9, 2021

(54) SOFA BED

(71) Applicant: Fama Sofas, S.L., Murcia (ES)

(72) Inventor: Félix López Gil, Murcia (ES)

(73) Assignee: Fama Sofas, S.L., Murcia (ES)

( * ) Notice: Subject to any disclaimer, the term of this patent is extended or adjusted under 35 U.S.C. 154(b) by 149 days.

(21) Appl. No.: 16/461,157

(22) PCT Filed: Nov. 17, 2017

(86) PCT No.: PCT/ES2017/070761
§ 371 (c)(1),
(2) Date: May 15, 2019

(87) PCT Pub. No.: WO2018/091757
PCT Pub. Date: May 24, 2018

(65) Prior Publication Data

US 2019/0274438 A1 Sep. 12, 2019

(30) Foreign Application Priority Data

Nov. 17, 2016 (ES) ..... ES201631474

(51) Int. Cl.
*A47C 17/13* (2006.01)
*A47C 17/12* (2006.01)
(Continued)

(52) U.S. Cl.
CPC ..... *A47C 17/13* (2013.01); *A47C 7/5068* (2018.08); *A47C 17/04* (2013.01); *A47C 17/12* (2013.01)

(58) Field of Classification Search
CPC ..... A47C 1/04; A47C 7/50; A47C 7/5068; A47C 17/04; A47C 17/12; A47C 17/13; A47C 20/00; A47C 27/142
See application file for complete search history.

(56) References Cited

U.S. PATENT DOCUMENTS 2,216,317 A * 10/1940 Karish ..... A47C 17/163 297/19
2,830,306 A * 4/1958 Wagner ..... A47C 27/144 5/722

(Continued)

FOREIGN PATENT DOCUMENTS

AT 009733 U1 3/2008
CN 210540154 U * 5/2020

(Continued)

*Primary Examiner* — David R Hare
*Assistant Examiner* — Alexis Felix Lopez
(74) *Attorney, Agent, or Firm* — The Webb Law Firm

(57) ABSTRACT

A sofa bed including a support structure configured to be placed on the floor, a main seat base arranged on the support structure, a front foldable leg rest fixed to the structure by a first articulation, and a cushioned flexible body that covers the main base and the leg rest is disclosed herein. The first articulation includes parallel mechanisms configured to provide a movement on a vertical plane with a combined movement of folding and a forward motion of the leg rest, the leg rest includes at least one lower leg, the cushioned flexible body includes machined parts and an upper layer with a greater elasticity than the rest of the cushioned body in an area that coincides with the first articulation. The sofa bed further includes foldable support elements located under the cushioned body in an area coinciding with the at least one machined part.

13 Claims, 5 Drawing Sheets

(51) Int. Cl.
*A47C 7/50* (2006.01)
*A47C 17/04* (2006.01)

(56) References Cited

U.S. PATENT DOCUMENTS 4,669,135 A * 6/1987 Gonzalez ..... A47C 17/1756 297/85 R
4,939,802 A * 7/1990 Lafer ..... A47C 17/161 5/42.1
5,103,510 A * 4/1992 Thurow ..... A47C 17/1756 5/37.1
5,156,441 A 10/1992 Byersmith et al.
5,597,210 A * 1/1997 Pickard ..... A47C 7/506 297/423.36
6,237,173 B1 * 5/2001 Schlichter ..... A47C 27/144 5/722
6,341,392 B1 * 1/2002 Makinen ..... A47C 17/1753 5/43
9,918,557 B2 * 3/2018 Baumeister ..... A47C 1/036
2006/0179566 A1 * 8/2006 James ..... A47C 27/081 5/12.1
2010/0102612 A1 * 4/2010 Walters ..... A47C 7/506 297/354.1
2013/0333110 A1 * 12/2013 Rodriguez ..... A47C 17/04 5/13
2013/0341989 A1 * 12/2013 Lin ..... A47C 7/5068 297/423.28
2015/0182029 A1 * 7/2015 Owens ..... A47C 23/02 5/719

FOREIGN PATENT DOCUMENTS

ES 1044124 U 3/2000
ES 1135881 U 2/2015
KR 101613519 B1 4/2016

* cited by examiner

SOFA BED

CROSS-REFERENCE TO RELATED APPLICATIONS

This application is the United States national phase of International Application No. PCT/ES2017/070761 filed Nov. 17, 2017, and claims priority to Spanish Patent Application No. P201631474 filed Nov. 17, 2016, the disclosures of which are hereby incorporated by reference in their entirety.

BACKGROUND OF THE INVENTION

Field of the Invention

The present invention relates to a sofa bed with a configuration that also provides support for the user's legs and has an easy operation for the configuration thereof into a bed and vice versa.

Description of Related Art

Several types of sofa beds are currently known. One type is configured by means of a structure that supports a double frame—seat and back—articulated by a sliding non-return ratchet, such that the back can horizontally fold in a coplanar way with the seat, the articulation sliding until reaching the center of the structure. Arranged on the assembly is a cushioned body that provides support in both configurations. This type of sofa bed has the drawback in that the folding of the back increases the occupation towards the rear, requiring the structure to be separated from the wall when the sofa is transformed into a bed and moving it back to the wall when going back to the armchair configuration if the sofa bed is placed against a wall, which is the most common arrangement for this type of furniture. Furthermore, the arrangement of the articulation in the longitudinal center of the bed provides discomfort in the area where the bed is most commonly used.

Another configuration consists of a bed base transversely articulated into two or three sections, which, by means of a complex mechanism assisted by springs or similar, allows for the rear and lower storage thereof in an enclosing drawer that provides structure to the sofa. This configuration has the drawback of the mechanical complexity, in that it is necessary to remove the cushions or pillows of the seat, which are the most voluminous, and find a place for them when the sofa bed is in the bed configuration, and in that the mattress is usually very thin and uncomfortable since it must be folded in the sofa configuration.

Another similar option, that is commonly used for hospital guest beds, also implements a storage mechanism with the help of springs on the inside of the drawer that configures the enclosure of the sofa bed, but without the bed base having to be folded or divided, and has the same drawback in that it requires additional storage for the cushions of the seat when the sofa bed is in the bed configuration, and furthermore the minimum depth of the sofa bed in the sofa configuration is very large-occupying a large and unnecessary space in the area-, and, on the other hand, the width of the bed in the corresponding configuration is very small, since the bed base without being folded must fit into the drawer that structures the sofa configuration.

Other options—such as trundle beds—which, when are not in use, also have the drawback of excessive depth of the seat, and as such, the cushions of the back must be very deep.

SUMMARY OF THE INVENTION

The sofa bed of the present disclosure has a simple configuration that solves the existing problems of other sofa beds.

According to the invention, the sofa bed comprises:

- a support structure on the floor,
- a main seat base arranged in said structure,
- a front, foldable leg rest, which is fixed to the structure by means of a first articulation and which in turn comprises lower legs, and
- a cushioned, flexible body which covers the main base and the leg rest.

In, the sofa bed object of the present disclosure, the first articulation comprises parallel mechanisms configured to provide movement on a vertical plane with the combined movement of unfolding and forward motion of the leg rest.

In the sofa bed object of the present disclosure, the cushioned, flexible body comprises machined parts and an upper layer of a material with greater elasticity than the rest of the cushioned body in an area that coincides with the first articulation.

Moreover, the sofa bed object of the present disclosure comprises foldable support elements located under the cushioned body coinciding with the machined parts.

The mechanisms of the sofa bed object of the present disclosure comprise:

- a first connecting rod and a second connecting rod respectively joined by a second rear articulation and a third forward articulation to a transverse horizontal section of the base,
- a third connecting rod joined by a third articulation to the first connecting rod and by a fourth upper articulation to the leg rest,
- a fourth connecting rod joined by a fifth articulation to the second connecting rod and by a sixth lower articulation to the leg rest,
- a seventh articulation which connects the first part of the third connecting rod to the last part of the second connecting rod.

In the sofa bed object of the present disclosure, the second connecting rod and the fourth connecting rod are straight and the first connecting rod and the third connecting rod have initial angled sections.

The sofa bed object of the present disclosure has mechanisms arranged on both sides of the base and leg rest.

In the sofa bed object of the present disclosure the lower legs are joined to the lower part of the leg rest by an eighth articulation.

In the sofa bed object of the present disclosure the lower legs comprise end wheels.

The leg rest of the sofa bed object of the present disclosure comprises automatic unfolding means.

The aforementioned automatic unfolding means of the leg rest comprise at least a first linear actuator that is mounted on the structure and aimed towards the leg rest, and joined to pushers by means of a ninth articulation, the pushers joined to said leg rest by means of a tenth articulation.

The tenth articulation of the sofa bed object of the present disclosure is arranged on a crossbar that joins the lower legs.

In the sofa bed object of the present disclosure the pushers have an angular form and comprise upper supports for the leg rest.

The sofa bed object of the present disclosure additionally comprises a back, which in turn comprises a rear cross-member fixed between two arms that in turn are fixed to the structure, the support cushions being arranged on said cross-member.

The arms of the sofa bed object of the present disclosure are fixed to the structure by the eleventh articulations, comprising means for adjusting the height of said arms.

In the sofa bed object of the present disclosure the means for adjusting the height of the arms are selected between non-return ratchets, and/or at least a second linear actuator articulated by means of bars to fifth connecting rods secured to the arms.

This way, by unfolding the leg rest and placing it in a coplanar way with the base of the seat, the widths of both are combined, providing a considerably wide bed without the need for the seat to have an excessive depth or the sofa bed occupying excessive space, not requiring the separation of the sofa bed from the wall and, furthermore, not requiring the storage of the cushions or pillows of the sofa in the bed configuration, since the cushioned body of the armchair configuration constitutes the mattress of the bed configuration, and must therefore be flexible or have a flexible area coinciding with the first articulation. Moreover, this configuration has the unexpected advantage in that placing the leg rest at intermediate heights provides support for the user's legs.

DESCRIPTION OF THE INVENTION

Figures 1, 2:
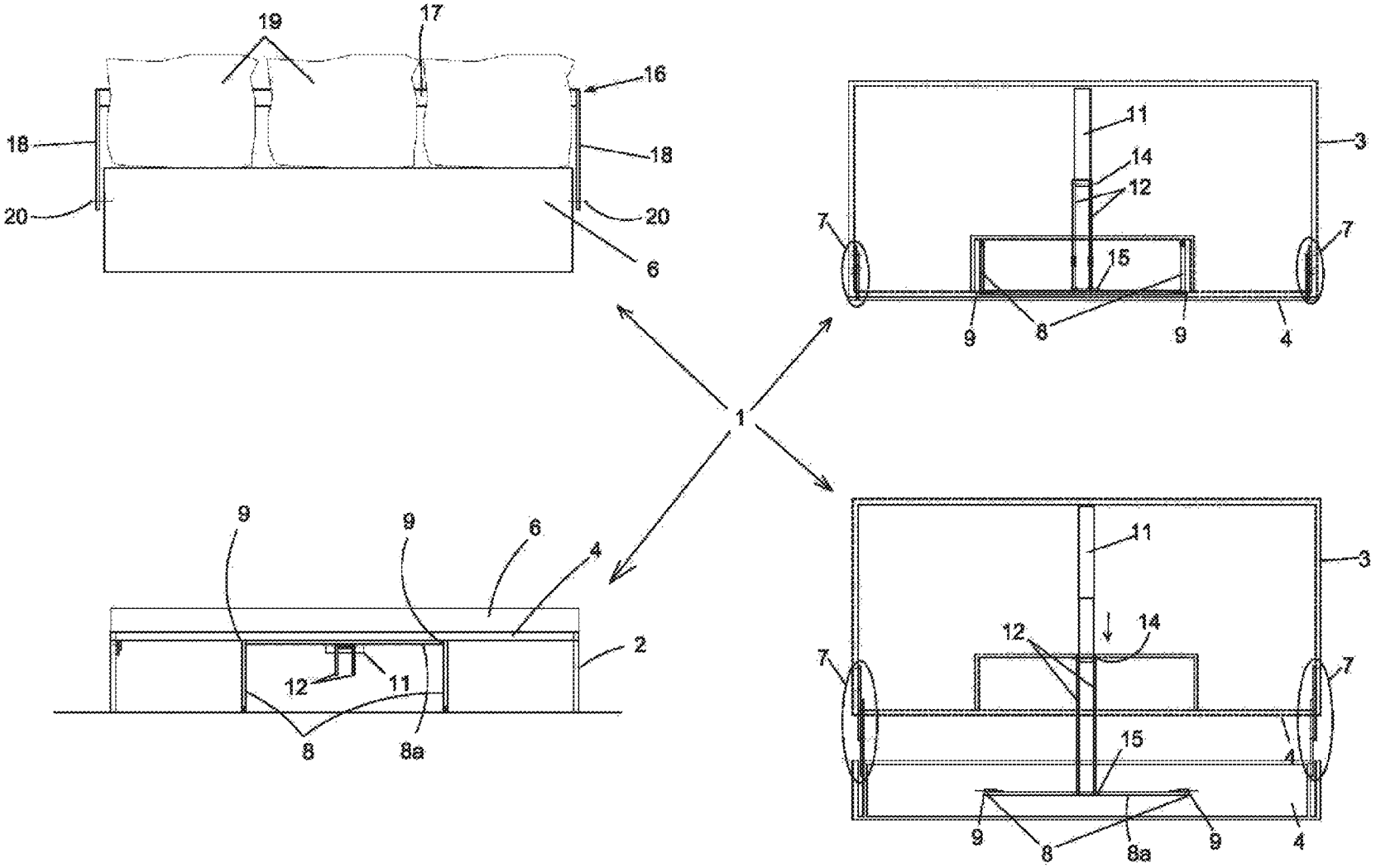
FIG. 1 shows two front views of the sofa bed of the present disclosure, the upper view showing the configuration of the sofa and the lower view showing the configuration of the bed.
FIG. 2 shows two views similar to that of FIG. 1, but in an upper plan view, and in which the pillows and cushioned bodies have been removed to be able to more clearly see the operation of the sofa bed.
Figure 3:
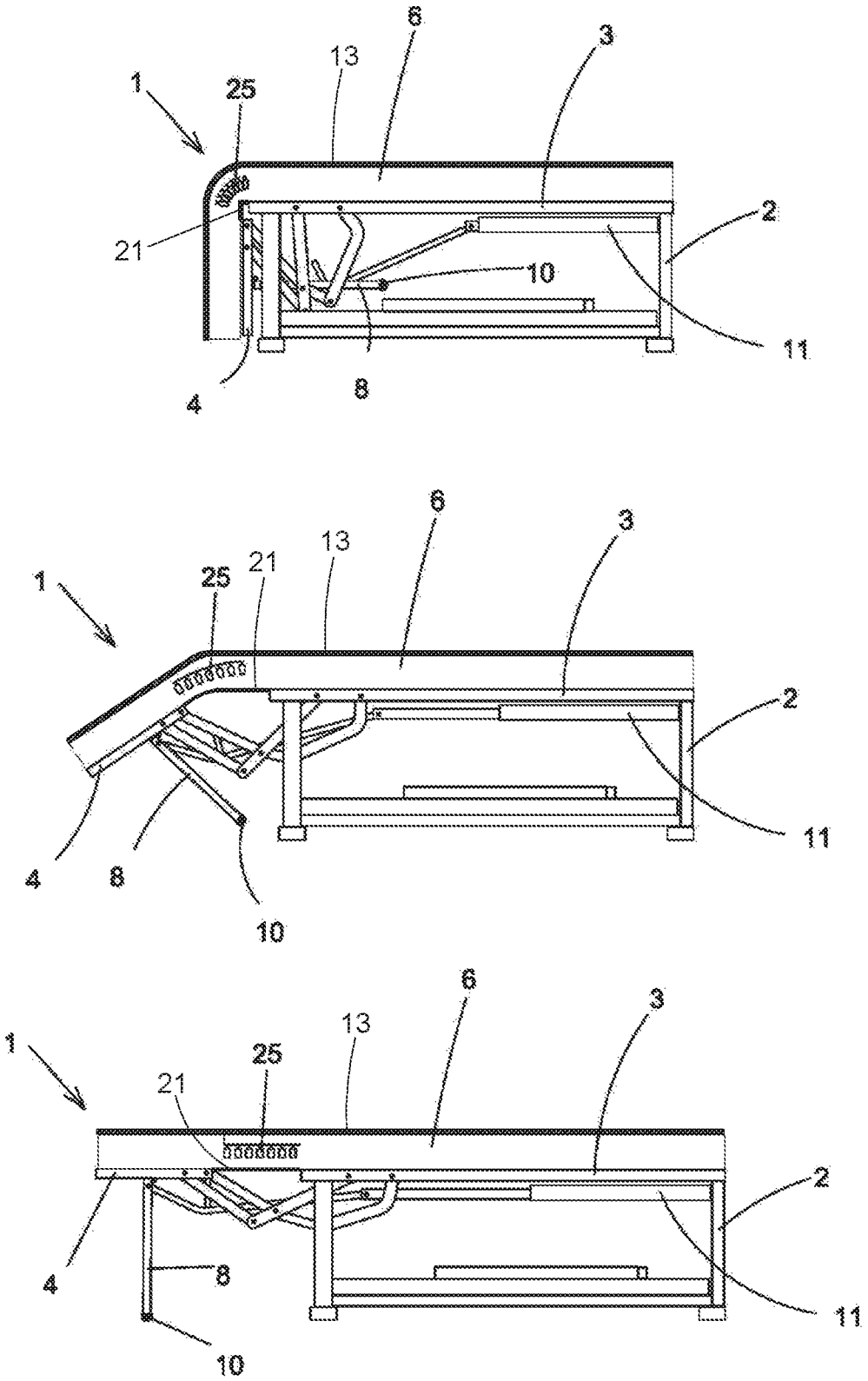
FIG. 3 shows three side views of the sofa bed of the present disclosure, the left-hand view showing the sofa configuration, the right-hand view showing the bed position, and the middle view showing an intermediate position in which it would serve as a sofa with support for the user's legs. The armrest is not shown so as to provide a better view of the present disclosure.

The sofa bed (1) of the present disclosure comprises:

a support structure (2) on the floor, a main seat base (3) arranged on said structure (2) on the upper part thereof, a front, foldable leg rest (4), which is fixed to the structure (2) by a first articulation (5) (see FIG. 2), and a cushioned, flexible body (6) which covers the main base (3) and the leg rest (4)

Figure 4:
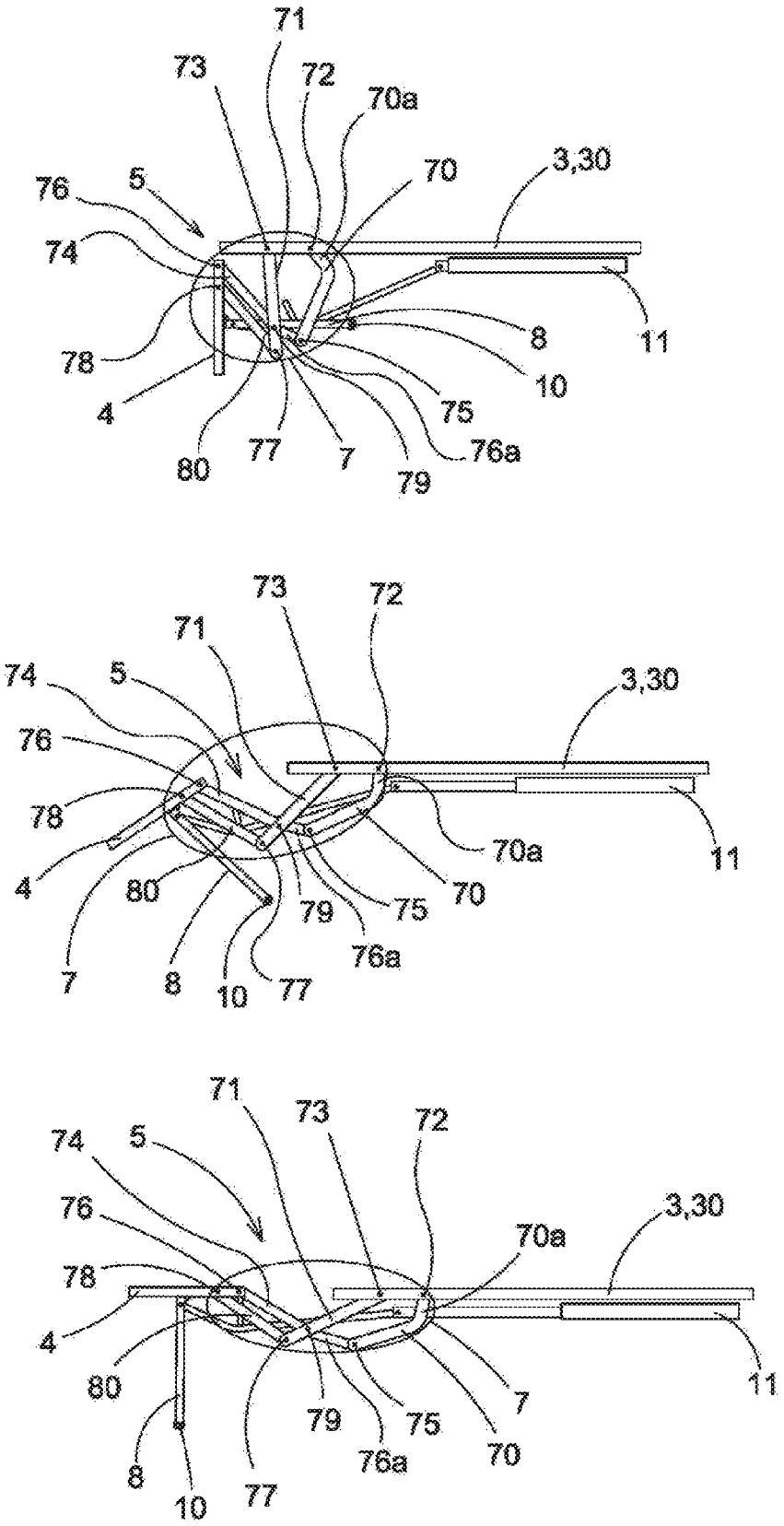
FIG. 4 shows three views similar to those of FIG. 3, but wherein only the base of the seat, the leg rest and the mechanisms that make up the first articulation are shown, including automatic actuation for raising the leg rest.

In the preferred configuration, the first articulation (5) comprises parallel mechanisms (7) (see FIGS. 2 and 4) for movement on a vertical plane (meaning articulations with a horizontal axis) with combined movement of unfolding and forward motion the leg rest (4) in a way so that the cushioned body (6) does not project from leg rest (4) in the bed configuration; and it is highly preferable that the mechanisms (7) comprise (see FIG. 4):

a first connecting rod (70) and a second connecting rod (71) respectively joined by a second rear articulation (72) and a third forward articulation (73) to a transverse horizontal section (30) of the base (3), a third connecting rod (74) joined by a third articulation (75) to the first connecting rod (70) and by means of a fourth upper articulation (76) to the leg rest (4), a fourth connecting rod (80) joined by a fifth articulation (77) to the second connecting rod (71) and by means of a sixth lower articulation (78) to the leg rest (4), a seventh articulation (79) connecting the first part of the third connecting rod (74) to the last part of the second (71) connecting rod, and wherein the second connecting rod (71) and the fourth connecting rod (80) are straight and the first connecting rod (70) and the third connecting rod (74) have initial angled sections (70*a*, 76*a*). This configuration simplifies the number of connecting rods and is robust. The mechanisms (7) can be arranged in any position, although in the present embodiment they are arranged on both sides of the base (3) and leg rest (4), given that this way additional reductions do not have to be made to the leg rest or the structure (3).

Figure 5:
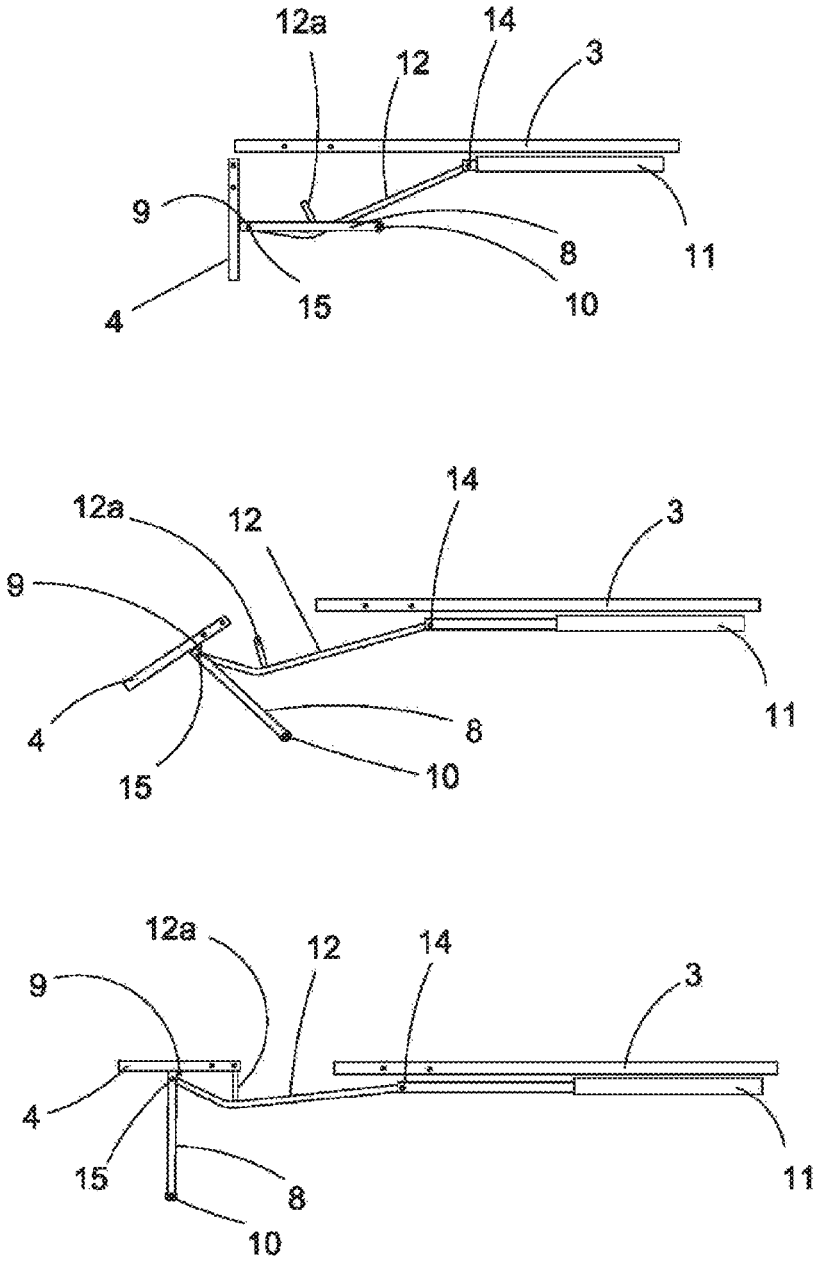
FIG. 5 shows three views that are similar to those of FIG. 4, but wherein the mechanisms are removed in order to more clearly see the automatic actuation.

To precisely support the weight on the leg rest (4) in the bed configuration, the present disclosure provides the arrangement of lower legs (8) below the same. Said lower legs (8) are preferably joined to the lower part of the leg rest (4) by means of an eighth articulation (9) (see FIGS. 1, 2 and 5) which allows for the partial rotation of the legs (8) with respect to the leg rest (4) during the movement of the transformation of the sofa bed. Moreover, it has been envisaged that the lower legs (8) comprise end wheels (10) to facilitate said movements by rolling on the floor.

With the aforementioned articulations, the leg rest (4) is able to provide a greater dimension to the area where it is placed when the sofa bed (1) is in the bed configuration, that is, in addition to being arranged in a horizontal position, it is distanced from the base (3), this way reaching a greater length than the length it has in the sofa configuration, such that is possible to obtain a bed with a width within the normal measurements of a double bed, without the need to have an oversized base (3).

A highly preferable configuration of the sofa bed (1) of the present disclosure envisages that the leg rest (4) comprises automatic unfolding means that allow for mobility towards both final positions of bed and sofa, and even intermediate positions wherein the leg rest (4) is precisely configured as a support for user's legs in the armchair configuration. Said means can comprise motors, hydraulic cylinders or any other known means, using the most preferable configuration of the present disclosure, due to the simplicity thereof, at least (see FIGS. 2 and 5) a first linear actuator (11) that is mounted on the structure (2) and aimed towards the leg rest (4) and which is joined to pushers (12) by means of a ninth articulation (14); the pushers (12) joined to said leg rest (4) by means of a tenth articulation (15). This tenth articulation (15) is ideally arranged on a crossbar (8*a*) that joins the lower legs (8), such that the movements of transforming the sofa bed simultaneously produce the movements of extension and retraction of the legs (8). Said pushers (12) preferably have an angular form since in the tests performed results show that they provide less resistance, having envisaged upper supports (12*a*) (see FIG. 5) for the leg rest (4) which bridge the gap created precisely by the angular form and provide an additional support point that maintains the leg rest (4) horizontal in the bed configuration.

Figure 6:
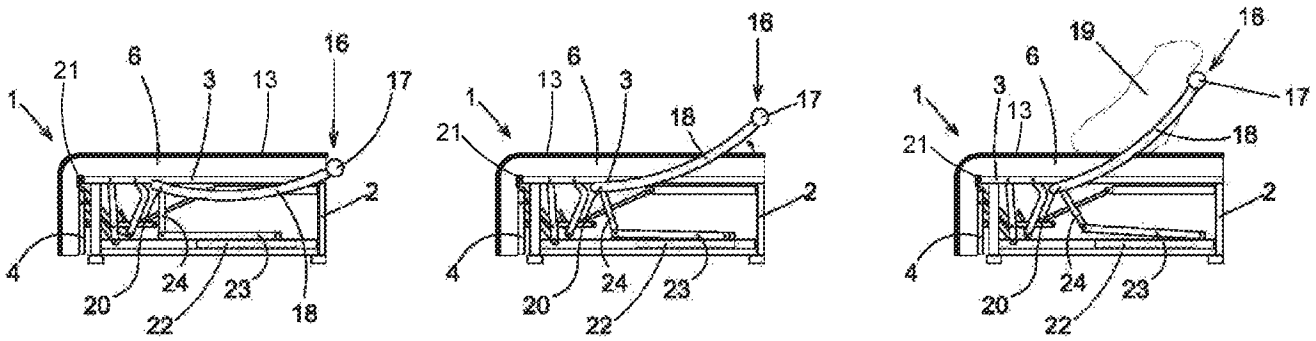
FIG. 6 shows three side views of the sofa bed of the present disclosure in three phases of the back elevation.
Figure 7:
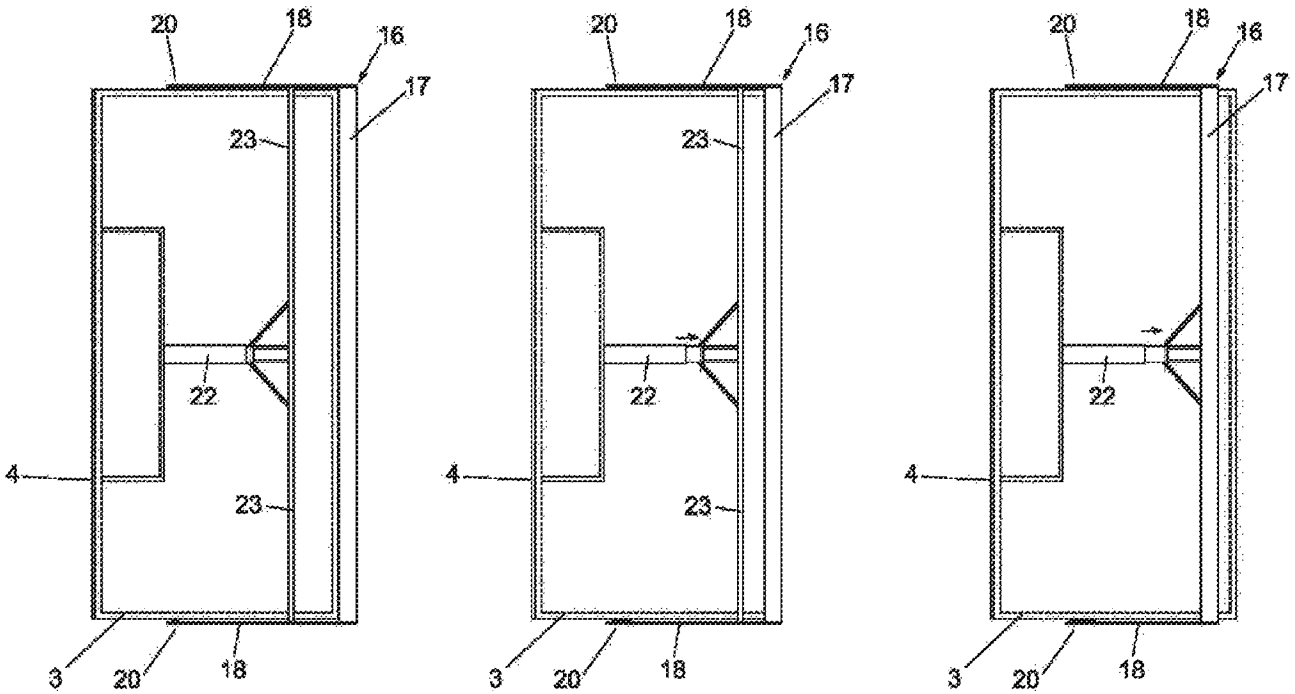
FIG. 7 shows three views similar to those of FIG. 6, but in an upper plan view, wherein the pillows and cushioned bodies have been removed to be able to more clearly see the operation of the sofa bed.

The present disclosure envisages the additional arrangement of a back (16) for the sofa bed (1) (see FIGS. 1, 6 and 7). Said back (16) ideally comprises a rear cross-member (17) fixed between two arms (18) that in turn are fixed to the structure (2), the support cushions (19) being arranged on said cross-member (17). This achieves a configuration that occupies very little space and does not affect the use in the bed configuration. However, it is envisaged that the arms (18) can be fixed to the structure (2) by the eleventh articulations (20), comprising means for adjusting the height of said arms (18). This allows for the adjustment of the support back (16) and the complete storage of the same, allowing the bed to be completely cleared. For this purpose, said arms (18) must have a slightly longer length than the distance of the eleventh articulations (20) at the end or edge of the main base (3).

The means for adjusting the height of the arms (18) can be any type of those existing in the state of the art, able to comprise non-return ratchets, not shown, and/or, at least a second linear actuator (22) (see FIG. 7) articulated by means of bars (23) to fifth connecting rods (24) secured to the arms (18) (see FIG. 6).

Finally, it must be indicated that in the area coinciding with the first articulation (5), the cushioned, flexible body (6) has machined parts (25) or transverse holes to increase the flexibility in this area, which more easily enables the folding without hollowing or lifting the cushioned body (6) in the area of the base (3) of the seat. Likewise, the cushioned body (6) comprises an upper layer (13) of a material with an elasticity that is greater than the rest of the cushioned body (6), said material in the preferred embodiment of the present disclosure being polyurethane foam, and the thickness of the upper layer is 3 centimeters. The upper layer (13) has smaller dimensions than the rest of the cushioned body (6) so that when the sofa bed (1) is in the sofa position, the leg rest (4) folds reducing the dimensions thereof and the upper layer (13) is smooth without creases, providing a comfortable support and a pleasant aesthetic to the aforementioned sofa.

The machined parts (25) of the cushioned body (6) allow said cushioned body (6) to extend with the combined movement of the unfolding and forward motion of the leg rest (4) with the sofa bed (1) in the bed position, and in turn, when the leg rest (4) is in a retracted position, in other words, the sofa bed (1) is in the sofa position, the cushioned body (6) is compressed without losing the form thereof from excessive compression of the aforementioned cushioned body (6).

In order for the sofa bed (1) in the bed configuration to have rigid and comfortable conditions so that the bed function can be enabled without problems of sinking or occasional deformation from supporting weight in the area of the leg rest (4), the sofa bed (1) object of the present disclosure, incorporates foldable support elements (21) located under the cushioned body (6) coinciding with the machined parts (25), in other words, also coinciding with the first articulation (5) that provides additional support when the sofa bed (1) object of the present disclosure is in the bed position.

Having sufficiently described the nature of the present disclosure, in addition to the way of applying it in practice, it must hereby be stated that the aforementioned arrangements indicated and represented in the attached drawings are susceptible to modifications with regard to the details thereof provided they do not alter the fundamental principle of the present disclosure.

The invention claimed is:

1. A sofa bed comprising:

a support structure configured to be placed on the floor, a main seat base arranged on the support structure, a front foldable leg rest, which is fixed to the structure by a first articulation a cushioned flexible body which covers the main seat base and the leg rest, wherein:

the first articulation comprises parallel mechanisms configured to provide a movement on a vertical plane with a combined movement of folding and a forward motion of the leg rest, the leg rest comprises at least one lower leg, the cushioned flexible body comprises at least one machined part and an upper layer comprising a material with a greater elasticity than the rest of the cushioned body in an area that coincides with the first articulation, and the sofa bed further comprises at least one foldable support element located under the cushioned body in an area coinciding with the at least one machined part.

2. The sofa bed according to claim 1, wherein the parallel mechanisms comprise:

a first connecting rod and a second connecting rod joined to a transverse horizontal section of the base by a second rear articulation, respectively, a third connecting rod joined to the first connecting rod by a third articulation and to the leg rest by a fourth upper articulation, a fourth connecting rod joined to the second connecting rod by a fifth articulation and to the leg rest by a sixth lower articulation, a seventh articulation connecting a first part of the third connecting rod to a last part of the second connecting rod, and wherein the second connecting rod and the fourth connecting rod are straight and the first connecting rod and the third connecting rod each comprise an initial angled section.

3. The sofa bed according to claim 1, wherein the parallel mechanisms are arranged on two sides of the base and leg rest.

4. The sofa bed according to claim 1, wherein the at least one lower leg is joined to an upper part of the leg rest by an eighth articulation.

5. The sofa bed according to claim 1, wherein the at least one lower leg comprises end wheels.

6. The sofa bed according to claim 1, wherein the leg rest further comprises an automatic unfolding means.

7. The sofa bed according to claim 6, wherein the automatic folding means comprises at least one first linear actuator mounted on the support structure, aimed towards the leg rest, and joined to at least one pusher by a ninth articulation, and the at least one pusher is further joined to the leg rest by means of a tenth articulation.

8. The sofa bed according to claim 7, wherein the tenth articulation is arranged on a crossbar that joins the lower legs.

9. The sofa bed according to claim 7, wherein the at least one pusher has an angular form and comprises at least one upper support for the leg rest.

10. The sofa bed according to claim 1, further comprising a back.

11. The sofa bed according to claim 10, wherein the back comprises a rear cross-member fixed between two arms that are fixed to the structure, and at least one support cushion arranged on the cross-member.

12. The sofa bed according to claim 11, wherein the arms are fixed to the structure by eleventh articulations comprising a means for adjusting the height of the arms.

13. The sofa bed according to claim 12, wherein the means for adjusting the height of the arms comprise:

an anti-return ratchet, and/or at least one second linear actuator connected to bars that are connected to fifth connecting rods that are secured to the arms.

* * * * *